United States Patent [19]

Bente

[11] 4,017,910

[45] Apr. 19, 1977

[54] TROUSERS FOR COMBINED TRAINING AND LEISURE SUIT

[75] Inventor: Alfred Bente, Herzogenaurach, Germany

[73] Assignee: Messrs. adidas Sportschuhfabriken Adi Dassler K.G., Germany

[22] Filed: Feb. 9, 1976

[21] Appl. No.: 656,409

[30] Foreign Application Priority Data

Mar. 5, 1975 Germany ..... 2509449

[52] U.S. Cl. ..... 2/232

[51] Int. Cl.[2] ..... A41D 1/08

[58] Field of Search ..... 2/232, 232 A, 227, DIG. 6, 2/228, 79

[56] References Cited

UNITED STATES PATENTS

| | | | |
|---|---|---|---|
| 653,157 | 7/1900 | Turner | 2/227 |
| 1,523,333 | 1/1925 | Wright | 2/227 X |
| 1,652,750 | 12/1927 | Wohlgemuth | 2/232 |
| 2,269,380 | 1/1942 | Plimpton | 2/227 |
| 3,733,615 | 5/1973 | Jaffee | 2/232 |

FOREIGN PATENTS OR APPLICATIONS

| | | | |
|---|---|---|---|
| 1,193,888 | 5/1959 | France | 2/227 |
| 1,441,725 | 5/1966 | France | 2/232 A |

OTHER PUBLICATIONS

"VELCRO" Tape Fasteners; Scovill–Oakvale Division; Reed in Pat. & TM Office, Sept., 1972.

*Primary Examiner*—H. Hampton Hunter
*Attorney, Agent, or Firm*—Marn & Jangarathis

[57] ABSTRACT

Trousers for a combined training and leisure suit are provided, at the lower end of each leg, with a first substantially vertically extending slit which can be closed by a zip fastener or a press-fit fastener and there is located within each leg a gaiter which is preferably secured to the inside of the trouser leg at approximately the location of the knee and this gaiter can be wrapped around the leg of a wearer and is also provided with a vertical slit which can be closed by an adjustable width fastener.

5 Claims, 2 Drawing Figures

TROUSERS FOR COMBINED TRAINING AND LEISURE SUIT

Figure 1:
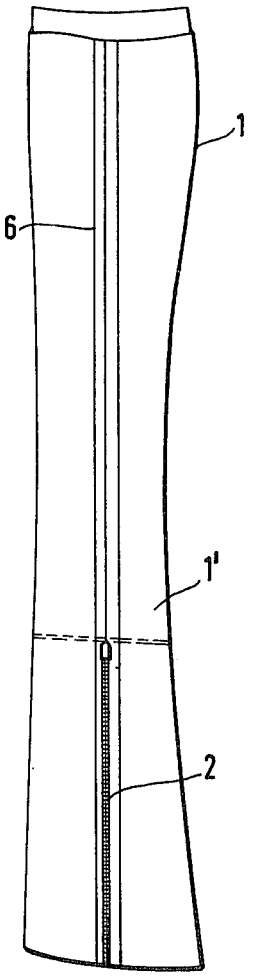

The present invention relates to trousers for combined training and leisure suits.

Training suits are nowadays frequently also used as leisure garments. The elastic strap normally provides at the lower end of the trouser legs of training suits, which engages round the sole of the foot when the trousers are worn, admittedly satisfies the desire that the trousers should fit tautly on the leg. As a result of the tight tension exerted by the elastic strap on the lower end of the trouser legs, the latter cannot hang as freely as would inherently be desirable for a leisure suit. A further disadvantage is that as a result of the downward pull exerted by the elastic strap on the trousers, the trouser waist can easily slip downwards, above all in the case of corpulence, and this naturally very adversely affects the way the trousers fit.

There is therefore a need for trousers which take into account both the requirements of the trousers of a training suit (namely a taut fit on the leg) and those of a leisure suit (namely that the trouser legs should hang freely and smoothly). In known trousers for a combined training suit and leisure suit, this is supposed to be taken into account by the fact that the lower ends of the trouser legs, by virtue of a zip fastener provided on their sides, tightly surround the leg below the calf, whilst when the zip fastener is opened they widen out to give a trouser leg which hangs freely and is closed all the way round. This is made posssible by providing an inset piece of material at the edges which are held together by the zip fastener, which piece of material fills the gap formed on opening the zip fastener.

Apart from the fact that trousers made up in this way are not as warm, when the zip fastener is opened, as are the trousers of a training suit which surrounds the lower part of the leg so tightly that cold air can hardly penetrate into the trouser legs from below, the way the trouser legs hand in the known trousers is also not satisfactory. This is due to the fact that, with the zip fastener closed, the inset piece of material is folded together more or less irregularly and therefore cannot hang as smoothly as a normal trouser leg.

According to the present invention we provide trousers for a combined training suit and leisure suit, said trousers comprising a pair of trouser legs, a first substantially vertically extending slit formed in each of the legs extending upwardly a distance from the lower end thereon, an openable fastener adapted to close said first slit, a gaiter secured within each trouser leg at the location of the first slit thereof and capable of being wrapped around the leg of a wearer, a second substantially vertically extending slit formed in the gaiter and an adjustable width fastener on the gaiter provided at the location of the second slit.

The openable fastener is preferably a zip fastener or a press-fit fastener. Advantageously, the gaiter is attached, or sewn in, above the upper end of the zip fastener or press-fit fastener. The fastener of adjustable width is preferably a cling tape which is in itself known, namely a so-called touch-and-close fastener which is formed by two tapes which in the closed position cling to one another or are hooked together, of which tapes either both are provided with small hooks formed by short wire-like fibres or only one is provided with such small hooks and the other is provided with small loops, such as are present in a plush construction (compare, for example U.S. Pat. Specification No. 3,027,566 and Austrian Pat. Specification 247,748). The two tapes are hooked together by pressing them against one another. However, they can also again be separated from one another by exerting a pull. Such fasteners are sold under the trade name "Velcro" and are generally known and therefore do not require particular description in the present context. It should merely still be pointed out that of the two tapes of the fastener, one must be on the inside and the other on the outside of the gaiter, so that, after the gaiter has been wrapped round the leg, the tapes can be brought into engagement with one another.

By appropriately tightly wrapping the gaiter round the leg, with the zip fastener open, it is possible to produce such a tight fit between the trousers and the leg that the trousers keep the leg just as warm, from below, as do training trousers. At the same time, however, the lower ends of the trouser legs hang, after closing the zip fastener, just as they do in the case of normal trousers. Accordingly the special advantage of the trousers according to the invention is that the means which provide a firm or tight fit (round the leg) are masked.

By appropriately wrapping the gaiter it is possible to achieve both a very practical and a comfortable fit for legs of different thicknesses. This fit is comfortable and also healthier than when using elastic, because the latter, having a given length in the unstretched state, either does not sit sufficiently tightly on thinner legs or, in the case of thicker legs, constricts the leg because of the high specific pressure. By means of the gaiter fitted into the trousers according to the invention the trouser legs can be provided with a unifromly tight fit both on thinner and on thicker legs, so that the trouser leg, which is virtually fixed to the leg below the calf by means of the gaiter, hangs down smoothly and freely. Accordingly the bulging in the area of the knee frequently observed even with normal trousers does not occur. As a result of the adaptability of the gaiter to various thicknesses of leg, it is possible effectively to counteract slipping-down of the trouser waist, even in the case of corpulence.

It will be appreciated that there is a genuine combination effect between the zip fastener or press-fit fastener provided at the side of the trouser legs, and the gaiter, inasmuch as it is only as a result of opening the zip fastener or press-fit fastener that the gaiter becomes accessible for wrapping or opening. To this extent, the action of the zip fastener or press-fit fastener provided in the trousers according to the invention is not comparable with the zip fastener in the known trousers described earlier, where the zip fastener serves to convert the trousers from training trousers into leisure trousers, or vice versa. Suitably, the lengthwise slit of the gaiter fitted into the trousers is on the same side of the trouser leg as the zip fastener or press-fit fastener, that is to say prefeably on the outside. This makes it easier to wrap or undo the gaiter.

Where a press-fit fastener is referred to in connection with the invention, the term is to be understood to mean fasteners such as the known plastic closures in which two strips provided with longitudinal profiles are joined together by hooking the profiles together under pressure, and can again be separated from one another by pulling. The closing and opening of the fastener can also be effected by means of a slide, similarly to the case of a zip fastener.

The gaiter, which can be produced from a cheaper textile material than the outer fabric of the trousers is suitably sewn in a little way below the knee and extends downwards to the point that the gaiter can be fixed by the fastener of adjustable width below the calf.

Though preferably a touch-and-close fastener is used for the purposes of the invention, the concept of the invention can also be realised with any other fastener which permits an adjustment in width to suit the various thicknesses of leg. Another embodiment of a fastener of adjustable width is, for example, a buckle with a strap running through it.

To assist the action of the fastener of adjustable width at the lower end of the gaiter it is optionally possible additionally to provide an elastic band which is relatively wide, and therefore does not constrict the leg, at the lower end of the gaiter.

It is true that ski trousers are known in which an elasticated turn-up is fitted into the trousers in the vicinity of the lower ends of the trouser legs. Here, the turn-up serves to produce a snow-tight seal between the trouser leg and the boot, which is why the lower end of the turn-up extends over the top edge of the boot upper. Since the uppers of ski boots are in any case very stiff, the elsatic band can be made very tight. However, such a turn-up joined to the trousers legs is neither intended nor able to influence the sit and hang of the trousers.

Figure 2:
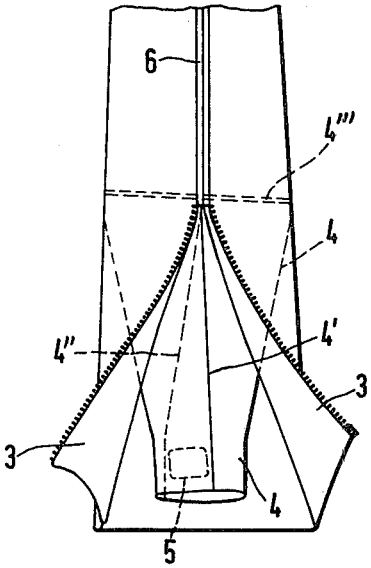

In order that the invention will be better understood, the following description is given, merely by way of example, reference being made to the accompanying drawing, in which:

FIG. 1 is a side view of one embodiment of trousers according to the invention; and FIG. 2 shows the lower end of a trouser leg of FIG. 1 with the zip fastener opened, to expose the gaiter fitted into the trouser leg.

Approximately in the bottom one-third of the trouser 1 illustrated in the drawing there is provided a substantially verticallly extending slit 3 which extends upwardly from the bottom edge of each leg/1' on the outside thereof. This slit may be opened or closed by a zip fastener 2, which is shown in the closed position in FIG. 1. With the zip fastener opened (FIG. 2), the edges fall apart, so that a gaiter 4 fixed inside the trouser leg is easily accessible. The vertical edges of this gaiter are marked 4', 4'' these defining a slit between them. A fastener of adjustable width. e.g. a so-called "Velcro" fastener (adherent tapes) is provided at the bottom end of the gaiter 4 and is shown by the broken line 5. In FIG. 2, the gaiter is in the wrapped position. Its upper end 4''' is immediately above the upper end of the zip fastener 2 and thus below the region of the knee. The replacement of the zip fastener 2 by another fastener which holds the edges 3 together, for example a row of buttons, would be regarded as an equivalent realisation of the concept of the invention.

On the outside, marking strips 6 are fixed to the side of the trousers, but the invention does not in any way concern these.

I claim:

1. Trousers for a combined training suit and leisure suit which comprises:

a pair of trouser legs, each of said trouser legs having a substantially vertically extending slit extending upwardly a distance from a lower end thereof;

an operable fastener adapted to close said substantially vertically extending slit of each of said trouser legs;

a gaiter positioned within each of said trouser legs proximate to said vertically extending slit of each of said trouser legs, said gaiter being fixed to said trouser legs a short distance below a knee region of said trouser legs and extending downwardly to a location below a calf region of said trouser legs, said gaiter being formed of overlapping portions; when wrapped around the circumference of the wearer's leg. and a touch and close fastener means disposed on said overlapping portions of said gaiter to permit variable width adjustment of said gaiter.

2. Trousers as claimed in claim 1, wherein said openable fastener is a zip fastener.

3. Trousers as claimed in claim 1, wherein the gaiters are each fixed in the respective trouser leg above the upper end of the fastener.

4. Trousers as claimed in claim 1 wherein said overlapping portions of said gaiter and said slit of each of said trouser legs are located on the same side of each of said trouser legs.

5. Trousers as claimed in claim 4, wherein said slits are arranged on the outside of the legs of the trousers.

* * * * *